US008079597B1

(12) United States Patent
Wei

(10) Patent No.: US 8,079,597 B1
(45) Date of Patent: Dec. 20, 2011

(54) STRIKING DEVICES FOR PRIZE-WINNING GAME MACHINES

(75) Inventor: Ming-Shan Wei, Taliao Township, Kaohsiung County (TW)

(73) Assignee: Paokai Electronic Enterprise Co., Ltd., Kaohsiung County (TW)

( * ) Notice: Subject to any disclaimer, the term of this patent is extended or adjusted under 35 U.S.C. 154(b) by 42 days.

(21) Appl. No.: 12/830,190

(22) Filed: Jul. 2, 2010

(51) Int. Cl.
*A63F 9/00* (2006.01)

(52) U.S. Cl. ..... 273/451; 273/447; 273/459; 273/460

(58) Field of Classification Search ..... 273/440, 273/447, 448, 451, 454, 459, 460
See application file for complete search history.

(56) References Cited

U.S. PATENT DOCUMENTS

| | | | | |
|---|---|---|---|---|
| 6,315,157 | B1 | 11/2001 | Halliburton | |
| 7,600,760 | B2 * | 10/2009 | Matsuda et al. | 273/447 |
| 7,934,723 | B2 * | 5/2011 | Sasaki et al. | 273/138.3 |
| 8,016,292 | B1 * | 9/2011 | Yang et al. | 273/451 |

FOREIGN PATENT DOCUMENTS

| | | | |
|---|---|---|---|
| JP | 2001212362 A | * | 8/2001 |
| JP | 2002172269 A | * | 6/2002 |
| JP | 2008054796 A | * | 3/2008 |

* cited by examiner

*Primary Examiner* — Raleigh W. Chiu
(74) *Attorney, Agent, or Firm* — Muncy, Geissler, Olds & Lowe, PLLC

(57) ABSTRACT

A striking device for a prize-winning game machine is disclosed, primarily comprising a striking head, an X-Z axis moving mechanism, and a Y-axis striking mechanism. The moving mechanism comprises two symmetrically disposed X-axis guiding rails and a Z-axis guiding rail where both ends of the Z-axis guiding rail are movably connected at X-axis guiding rails. The Y-axis striking mechanism can movably connected at the Z-axis guiding rail and comprises a Y-axis guiding rail and a striking rod moving along and disposed on the Y-axis guiding rail. The striking rod is off-axis aligned and connected to a back surface of the striking head for striking the targets in the prize-winning game machine. Therefore, the Y-axis striking mechanism will not be tilted or shifted during numerous striking operations to greatly increase the durations of the striking head and the striking mechanism.

20 Claims, 8 Drawing Sheets

STRIKING DEVICES FOR PRIZE-WINNING GAME MACHINES

FIELD OF THE INVENTION

The present invention relates to a coin-actuated game machine, especially to a striking device for a prize-winning game machine.

BACKGROUND OF THE INVENTION

There are various prize-winning game machines in the existing coin-operating amusement industry to provide entertainment to both young and old. General speaking, prize-winning game machines will exhibit the prizes to the public to clearly show what the game players can get when they win to give them the motivation to play. There are different prize-winning game machines with different games using different operation modes. One of them is the long-distance shooting game machine where the prizes are given by the scores. Another one is the crane where a capturing device such as a bucket or a claw is maneuvered by the player to catch the desired prize in a playing field filled with all kinds of prizes. The other one is to strike certain targets to receive corresponding prizes.

As the development of game machines, one has proposed a game machine to received prizes through striking targets such as revealed by Halliburton taught in U.S. Pat. No. 6,315,157 B1 entitled "grid skill amusement game or dispensing device". A conventional amusement device is provided which allows an operator to exercise his skill to attempt to align a ram or a pusher directly opposite a tubular member which contains a prize. The ram is attached to a bracket secured to a belt on a horizontal member of a support member which can move in response to operator control in a lateral direction along the length of the horizontal member. The horizontal member is attached to belts on opposite vertical members of the support member which enable the horizontal bar to travel in a vertical direction in response to operator control. This arrangement allows an operator to position the ram at any location within in a plane defined by the support member including the horizontal and vertical members. In use, the operator attempts to exercise his skill to directly align the ram in front of an opening of a desired target member from an array of target tubular members. When the operator is satisfied with the location of the ram, or after a predetermined time has elapsed, the ram is driven forward along a third axis toward the tubular member. If an operator has accurately lined the ram up with a target member, the ram will center the target member and push any object contained within the member out the rear. The item falls from the array through a chute to a dispensing area which can be accessed by the operator.

However, when the ram is released by an operator to center the target member to push any object contained within the support member out the rear during the game, it is highly probably that the ram will not center the member but hit the peripheries of the target member. After multiple hitting of the ram on the peripheries of the target member, the ram will easily be damaged affecting the operation of the horizontal members and the vertical members leading to shorter maintenance and repair cycles and even breakdown of the game machine after a period of time. Moreover, the ram after multiple hitting will be shaking during targeting leading to lower prize winning probability which will reduce the interests of an operator playing the game machine.

SUMMARY OF THE INVENTION

The main purpose of the present invention is to provide a striking device for a prize-winning game machine to avoid shaking of Y-axis striking mechanism after multiple striking to greatly increase the duration of maintenance and repair as well as the lifetime of the game machine.

The second purpose of the present invention is to provide a striking device for a prize-winning game machine enabled to interchange striking heads for easy maintenance and repair and to interchange different dimensions of striking heads for different gaming requirements.

According to the present invention, a striking device for a prize-winning game machine comprises a striking head, an X-Z axis moving mechanism, and a Y-axis striking mechanism. The striking head is used to hit the targets within the prize-winning game machine. The moving mechanism including two symmetrically disposed X-axis guiding rails and a Z-axis guiding rail where both ends of the Z-axis guiding rail can be horizontally movably connected at the X-axis guiding rails and the Y-axis striking mechanism can be vertically movably connected at the Z-axis guiding rail. The Y-axis striking mechanism includes a Y-axis guiding rail and a striking rod frontward moving along and disposed on the Y-axis guiding rail wherein the front end of the striking rod is off-axis aligned to and connected to a back surface of the striking head.

The striking device for prize-winning game machine according to the present invention has the following advantages and effects:

1. Through specific combinations of the striking head and the Y-axis striking mechanism as a technical mean, the striking head connected by the striking rod can move along the Y-axis rail of the Y-axis striking mechanism, therefore, the shaking of the Y-axis mechanism after multiple striking the targets can be avoided to greatly increase the duration of maintenance and repair as well as the lifetime of the game machine. Additionally, the X-axis guiding rails can be immovable secured in the prize-winning game machine.
2. Through specific combinations of the striking head and the Y-axis striking mechanism as a technical mean, the striking head is off-axis aligned and connected to one end of the striking rod of the Y-axis striking mechanism so that the striking head is interchangeably jointed to the striking rod of the Y-axis striking mechanism, therefore, the striking head can easily be replaced for maintenance and repair or even interchange different dimensions of striking heads for different gaming requirements.

DETAILED DESCRIPTION OF THE INVENTION

With reference to the attached drawings, the present invention is described by means of the embodiment(s) below where the attached drawings are simplified for illustration purposes only to illustrate the structures or methods of the present invention by describing the relationships between the components and assembly in the present invention. Therefore, the components shown in the figures are not expressed with the actual numbers, actual shapes, actual dimensions, nor with the actual ratio. Some of the dimensions or dimension ratios have been enlarged or simplified to provide a better illustration. The actual numbers, actual shapes, or actual dimension ratios can be selectively designed and disposed and the detail component layouts may be more complicated.

Figure 1:
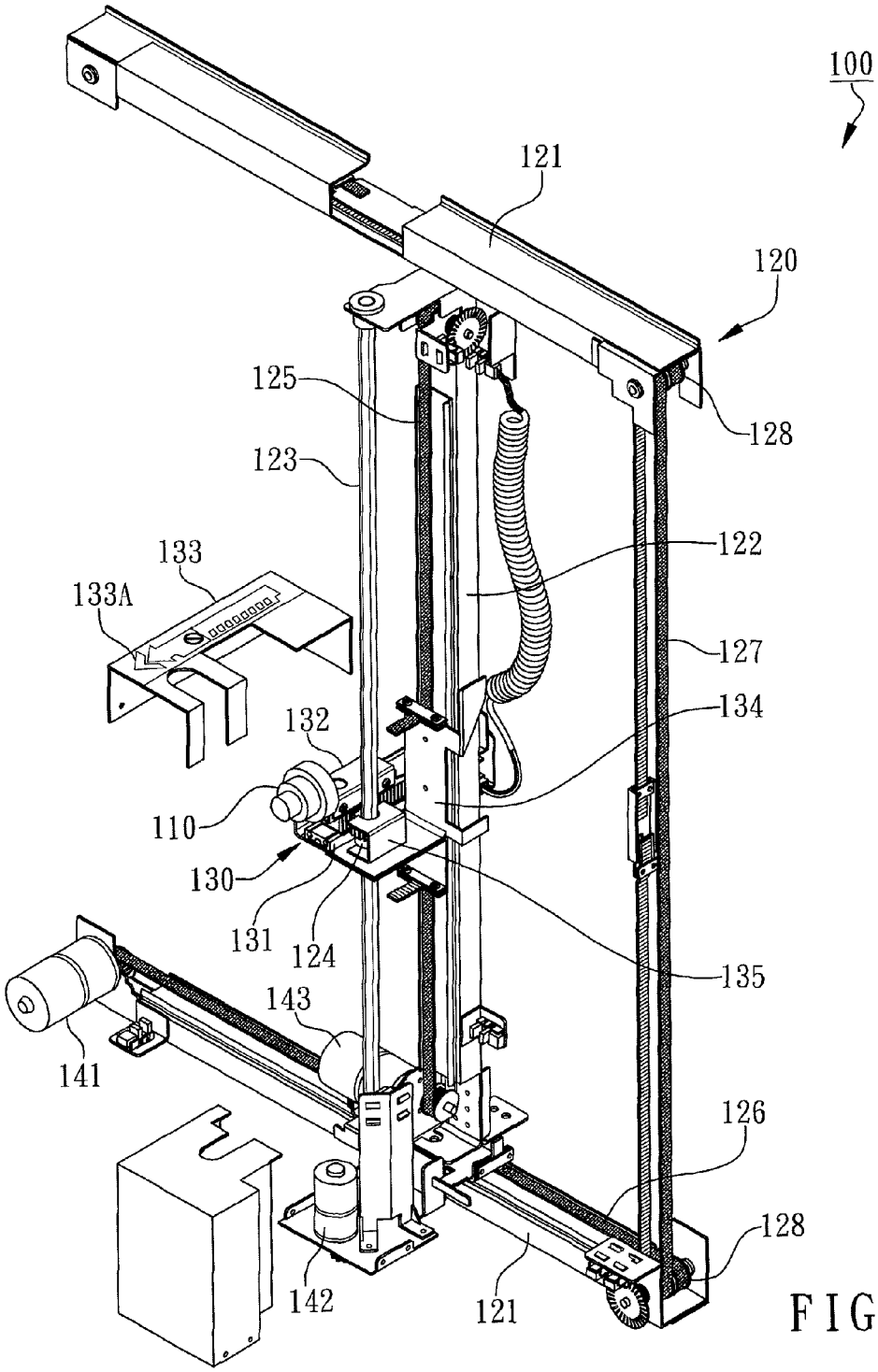
FIG. 1 is a three-dimensional rear view of a striking device for a prize-winning game machine according to the preferred embodiment of the present invention.
Figure 2:
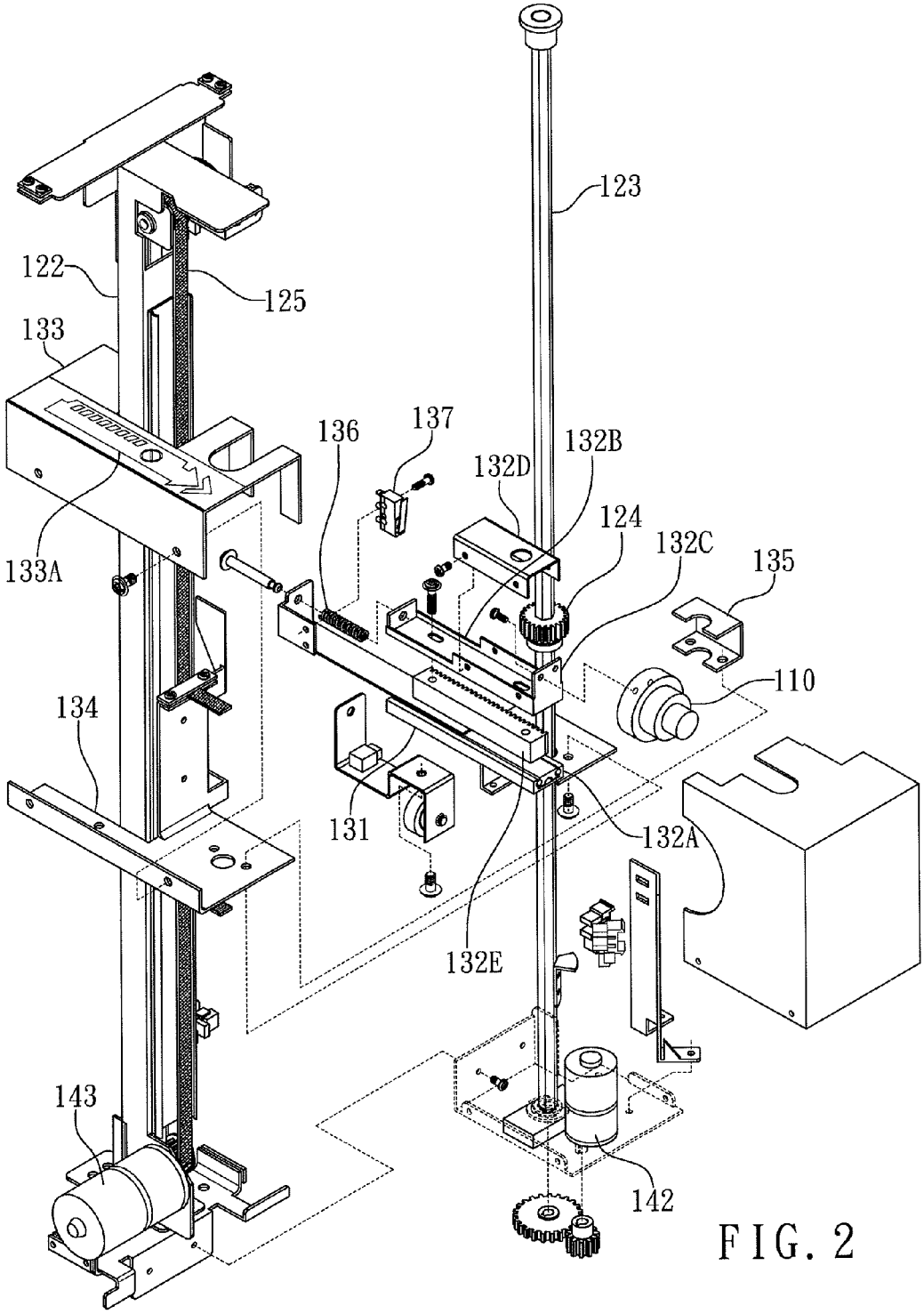
FIG. 2 is a three-dimensional exploded view of the striking device according to the preferred embodiment of the present invention.
Figure 3:
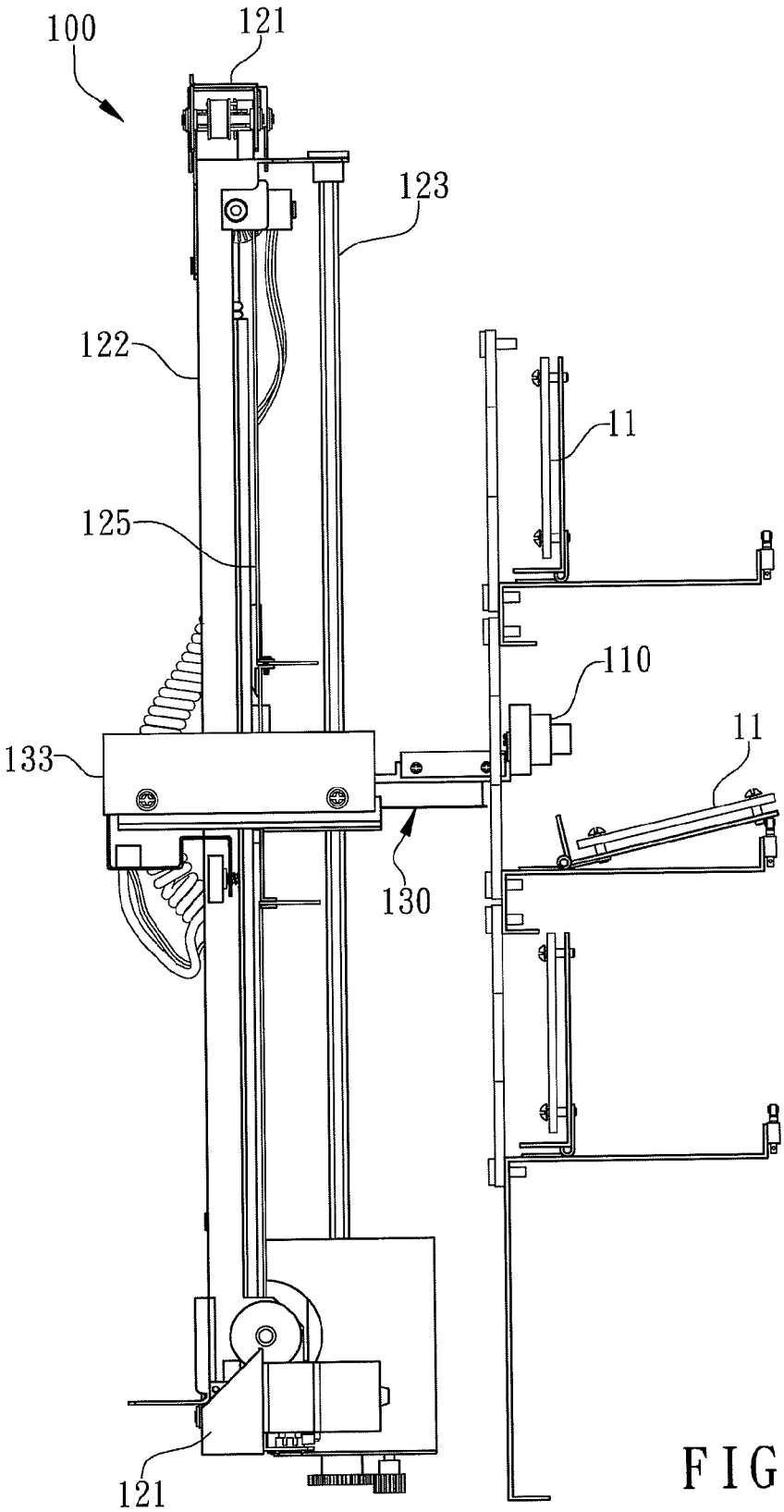
FIG. 3 is a side view of the striking device when pushing out the striking head according to the preferred embodiment of the present invention.

According to the preferred embodiment of the present invention, a striking device for a prize-winning game machine is illustrated in FIG. 1 for a three-dimensional rear view, in FIG. 2 for a three-dimensional exploded view, and in FIG. 3 for a side view when striking a target. The striking device 100 is implemented in a prize-winning game machine. The striking device 100 primarily comprises a striking head 110, an X-Z axis moving mechanism 120, and a Y-axis striking mechanism 130. To be described in detail, please refer to FIG. 6 for detail description, "X-axis" is defined as the left-and-right horizontally moving direction of the striking head 110 and the Y-axis striking mechanism 130 when the player is facing the game machine 10. "Y-axis" is defined as the back-and-forth horizontally moving direction of the striking head 110 when the player is facing the game machine 10. "Z-axis" is defined as the up-and-down vertically moving direction of the striking head 110 and the Y-axis striking mechanism 130 when the player is facing the game machine 10. Therefore, when alternatively driving the X-Z moving mechanism 120 and the Y-axis striking mechanism 130, the striking head 110 will be able to move along the X-Z plane as well as the Y-axis for linear striking movement to achieve aligning, aiming, and striking purposes for the game. However, the X-, Y-, and Z-axes are not limited to the present invention but can be arbitrarily changed according to the requirements of the games.

Figure 5:
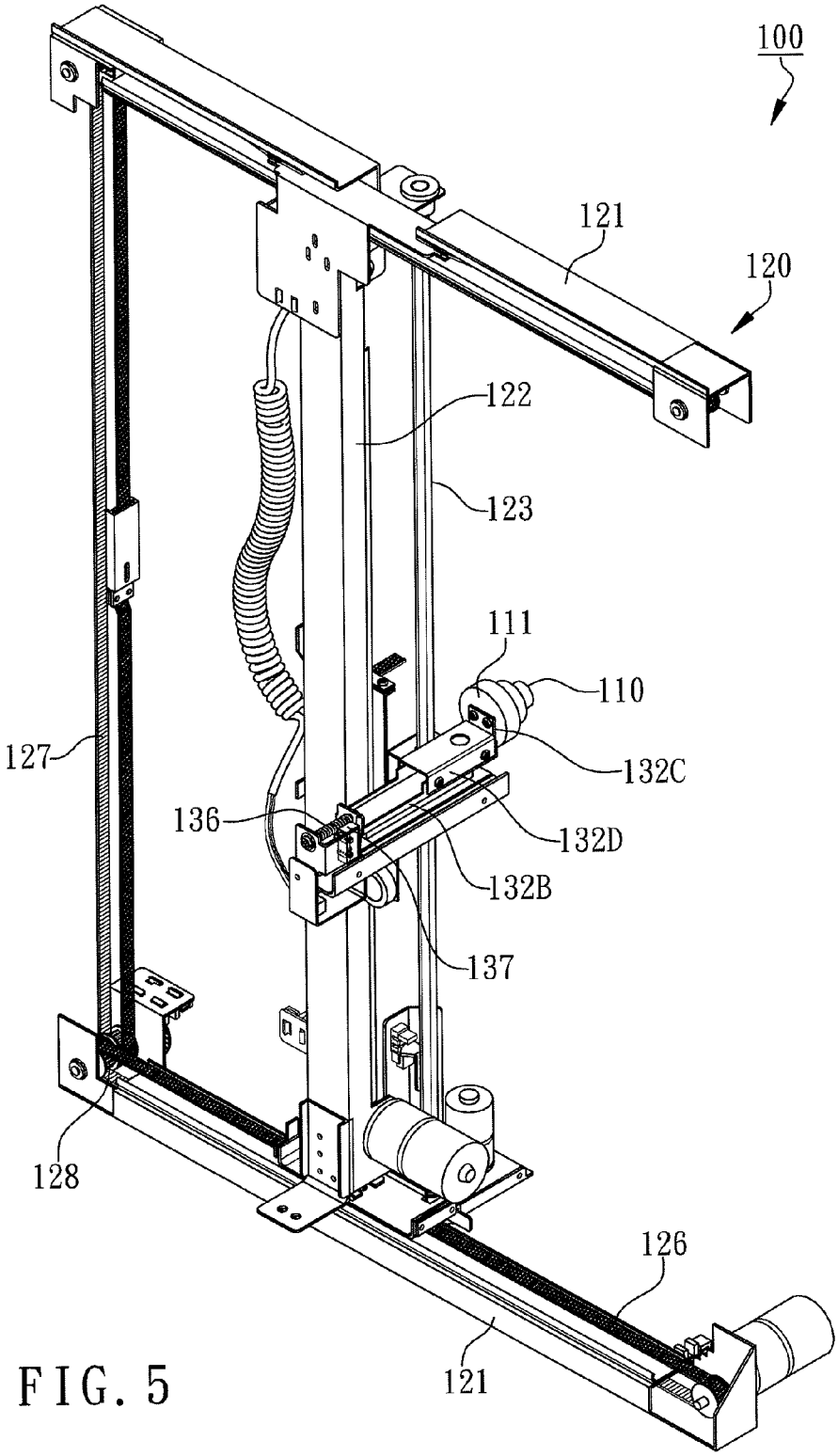
FIG. 5 is a three-dimensional front view of the striking device according to the preferred embodiment of the present invention.

As shown in FIG. 3, the striking head 110 is used to strike a plurality of targets 11 in the prize-winning game machine 10. To be more specific, the shape of the striking head 110 can be a stair-like multiple-circle cylinder to form a striking end and a back surface 111 which has larger diameter and dimension than the one of the striking end. As shown in FIG. 5, the striking head 110 is jointed to the Y-axis striking mechanism 130 with the back surface 111 and can strike the aimed target 11 with the striking end. In a preferred embodiment, the striking head 110 is made of metal with stronger rigidity. In another embodiment, the striking head 110 is made of plastic with a lighter weight for easily assembly and replacement.

As shown in FIG. 1 and FIG. 3 again, the moving mechanism 120 includes two symmetrically disposed X-axis guiding rails 121 and one Z-axis guiding rail 122 where both ends of the Z-axis guiding rail 122 are movably connected at the X-axis guiding rails 121. The Y-axis striking mechanism 130 is movably connected at the Z-axis guiding rail 122. In the present embodiment, the Z-axis guiding rail 122 is vertically disposed between the X-axis guiding rails 121 where two X-axis guiding rails 121 are parallel to each other. Therefore, the Y-axis striking mechanism 130 and the striking head 110 can move within a stable X-Z plane by the moving mechanism 120 to further accurately control the position of the striking head 110. Furthermore, the moving mechanism 120 comprises a plurality of horizontal-moving gear belts 126 and a synchronized gear belt 127 where the horizontal-moving gear belts 126 are disposed inside the X-axis guiding rails 121 and both ends of the Z-axis guiding rails 122 are jointed to the horizontal-moving gear belts 126 so that the Z-axis guiding rail 122 can be driven in the left and right direction when the horizontal-moving gear belts 126 move. The synchronized gear belt 127 is disposed on the same side of the X-axis guiding rails 121 where the horizontal-moving gear belts 126 and a synchronized gear belt 127 are jointed by a plurality of gear axes 128. When the horizontal-moving gear belts 126 in the bottom X-axis guiding rail 121 are driven by a motor 141 of the striking device 100, the gear axe 128 also drives the synchronized gear belt 127. Then, the synchronized gear belt 127 drive the horizontal-moving gear belts in the upper X-axis guiding rail 121 through the gear axes 128. Therefore, when the motor 141 turns, the Z-axis guiding rail 122 is able to move right and left through the horizontal-moving gear belts 126 and the synchronized gear belt 127. The X-axis position of the Y-axis striking mechanism 130 is also changed. Moreover, the Y-axis striking mechanism 130 can move up and down along the Z-axis guiding rail 122 by a vertically moving gear belt 125 which is parallel to the Z-axis guiding rail 122 to achieve the Z-axis movement of the Y-axis striking mechanism 130. For example, the vertically moving gear belt 125 is driven by a motor 143 at the bottom end of the Z-axis guiding rail 122, the vertically moving gear belt 125 turn to drive the Y-axis striking mechanism 130 connected with the vertically moving gear belt 125 so that the Z-axis position of the Y-axis striking mechanism 130 on the Z-axis guiding rail 122 can be easily changed. In the present embodiment, a plurality of light-sensing devices (not shown in the figure) are disposed in the X-Z moving mechanism 120 located below both ends of the X-axis guiding rail 121 and both ends of the Z-axis guiding rail 122. When the light between the light sensing devices disposed below the X-axis guiding rail 121 are blocked by the Z-axis guiding rail 122, the motor 141 will shut down and stop which means that the Z-axis guiding rail 122 has arrived at the specific positions so that the damages to the motor 141 due to over driving can be avoided.

As shown in FIG. 1 and FIG. 3, the Y-axis striking mechanism 130 includes a Y-axis guiding rail 131 and a striking rod 132 moving along the Y-axis guiding rail 131. The Y-axis guiding rail 131 is a rail component to guide the striking rod 132 moving linearly and to further guide and constrain the moving direction of the striking rod 132, usually being a plate having two parallel limiting parts, such as two side grooves in a slideway. The front end of the striking rod 132 is off-axis aligned to and connected to a back surface 111 of the striking head 110, i.e., the Y-axis striking central axis of the striking head 110 and the Y-axis center of the striking rod 132 are not aligned to a same central line without the shifting and tilting issues during striking, and the striking head 110 can easily be replaced and assembled. To be more specific, as shown in FIG. 2 again, the striking rod 132 includes a sliding base 132A and a striking head guiding bar 132B where the sliding base 132A is movably embedded in the Y-axis guiding rail 131 so that the striking rod 132 can slide along the Y-axis guiding rail 131. For example, two slide sides of the sliding base 132A are inserted in and limited by two side grooves of the Y-axis guiding rail 131. Furthermore, the striking head guiding bar 132B is disposed on the sliding base 132A for connecting and fixing the striking head 110. The connected end of the striking head guiding bar 132B can be a vertical plate 132C to firmly hold the striking head 110. In a preferred embodiment, the vertical plate 132C and the striking head guiding bar 132B are integrated into an L-shape bending structure where the vertical plate 132C is vertically extruded from the front end of the striking head guiding bar 132B.

In another variation of an embodiment, the vertical plate 132C can be soldered on the striking head guiding bar 132B. The striking driven mechanism of the striking rod 132 also can be chosen from spring, oil pressure, or gear and gear bar where gear and gear bar is preferred in this embodiment which will make the striking rod 132 accurately and smoothly move in linear motion.

In the present invention, through specific combinations of striking head 110 and Y-axis striking mechanism 130 as a technical mean, the striking head is off-axis aligned and connected to one end of the striking rod 132 of the Y-axis striking mechanism 130 and the striking rod 132 is moving along the Y-axis rail 131 of the Y-axis striking mechanism 130 so that the striking rod 132 can linearly and smoothly move along the Y-axis guiding rail 131 to accurately drive the striking head 110 to complete striking actions. Therefore, the shaking of the Y-axis mechanism 130 after multiple striking the targets can be avoided to greatly increase the duration of maintenance and repair as well as the lifetime of the game machine.

Furthermore, there are various specific combinations of the striking head 100 and the Y-axis striking mechanism 132 to form various embodiments such as direct soldering the striking head 110 to the vertical plate 132C of the striking rod 132 or integration of striking head 110 and the striking rod 132 in the same structure to offer a stronger structure to withstand striking. But in a preferred embodiment, as shown in FIG. 1 and FIG. 5, the striking rod 132 can be detachably assembled with and disassembled from the striking head 110 such as fixing the striking head 110 to the vertical plate 132C by a plurality of joint screws 112. Once the striking head 110 is damaged or worn out due to long term usage, therefore, the off-axis aligned striking head 110 can be easily replaced for maintenance and repair or even interchange different dimensions of striking heads 110 for different gaming requirements.

As shown in FIG. 1 and FIG. 2 again, in a preferable embodiment, the Y-axis striking mechanism 130 further includes a shell 133 accommodating the Y-axis guiding rail 131 and the striking rod 132 after retraction where an aiming mark 133A aligned to the striking head 110 is disposed on the shell 133. Since the striking rod 132 is off-axis aligned and connected to the striking head 110, the back surface 111 of the striking head 110 has a larger area and the striking rod 132 is off-axis aligned to the striking head 110 so that the aiming mark 133A on the shell 133 can be aligned to the back surface 111 of the striking head 110. In a preferred status, the shape of the aiming mark 133A can be an arrow. In another embodiment, the aiming mark 133A can be a direction pointer such as a sword, a canon, etc. In a preferred embodiment, the aiming mark 133A can be a sticker adhered on the top surface of the shell 133 or can be directly printed on the shell 133 or painted on the shell 133. However, no matter the aiming mark 133 is disposed in whatever formats, it is to help the player to easily recognize the aiming mark 133 to easily control the striking device 100 to achieve aligning, aiming, and striking of the striking head 110. Moreover, the shell 133 can be in any shapes or appearance according to the requirements such as rectangles, cylinders, etc, to protect the components inside as well as to beautify the striking device 100 to attract the interests of people to play.

Preferably, as shown in FIG. 2, the striking rod 132 further includes a reinforced plate 132D locked on the striking head guiding bar 132B to reinforce the strength of the vertical plate 132C. In the present embodiment, the reinforced plate 132D can be a U-shaped bent metal plate with the orientation of an opening opposite to the orientation of the opening of the striking head guiding bar 132B to support the other side of the vertical plate 132C which is not connected to the striking head 110 to provide supporting strength of the vertical plate 132C during striking of the striking head 110. Therefore, the reinforced plate 132D can prevent the bending and distortion of the vertical plate 132C due to striking and the tilting and shifting of the striking head 110.

Figure 4:
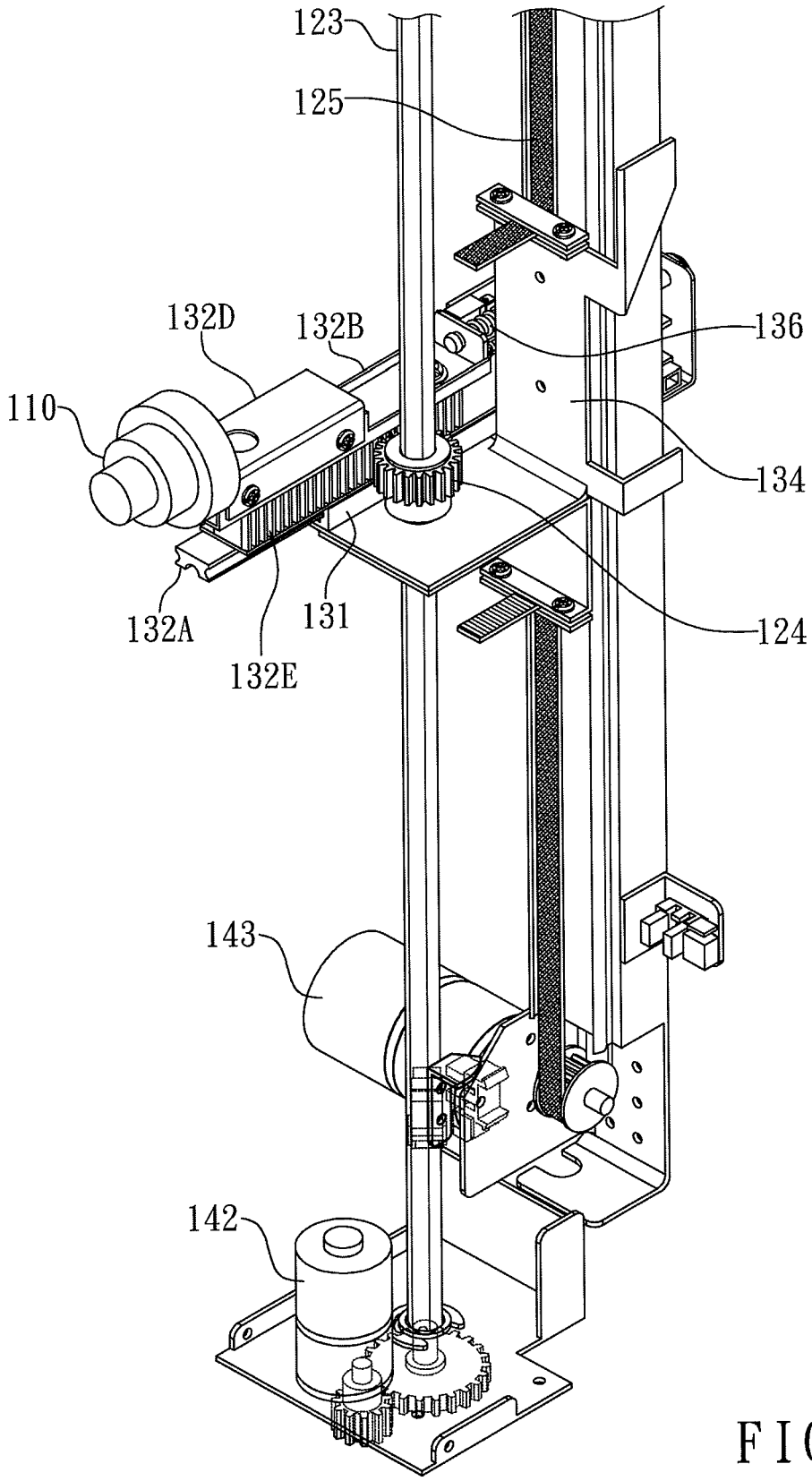
FIG. 4 is a partially three-dimensional rear view illustrating the joint between gears and racks of the striking device according to the preferred embodiment of the present invention.

In a preferred embodiment, as shown in FIG. 4 as well as in FIG. 2, the striking rod 132 further includes a gear bar 132E disposed on the sliding base 132A. A rotating axis 123 parallel to the Z-axis is disposed adjacent to the Z-axis guiding rail 122 where a gear 124 is penetrated by the rotating axis 123 and gear-connected with the gear bar 132E so when the rotating axis 123 rotates driven by a motor 142 at the bottom end of the Z-axis guiding rail 122, it drives the gear 124 to rotate and further drive the gear bar 132E moving in Y-axis, i.e., to drive the striking head guiding bar 132B to eventually drive the striking head 110 moving linearly in Y-axis direction. In the present embodiment, the gear 124 simultaneously rotates when the rotating axis 123 is rotated by the motor 142. Therefore, the motor 142, though the combination of the rotating axis 123, the gear 124, and the gear bar 132E, the movement of the striking head 110 can be triggered by the operations of the player to strike and the striking force and speed can be adjusted by changing the rotating speed of the rotating axis through the motor 142. In a preferred embodiment, the cross-section of the rotating axis 123 can be hexagonal which can match with the internal shape of the axis hole of the gear axis 124 but the gear 124 still can move up and down along the rotating axis 123. Furthermore, the striking head guiding bar 132B are not directly jointed to the sliding base 132A but by disposing the gear bar 132E on top of the sliding base 132A and by disposing the striking head guiding bar 132B on top of the gear bar 132E to achieve a balance of the driving force.

Moreover, as shown in FIG. 2 and FIG. 4, the Y-axis striking mechanism 130 further includes a support rack 134 movably connected at the Z-axis guiding rail 122. The Y-axis guiding rail 131 is carried on the support rack 134 which has a constraining component 135 to simultaneously drive the gear 124 moving up and down along Z-axis as the Z-axis movement of the Y-axis striking mechanism 130. To be more specific, the support rack 134 is a carrier component of the Y-axis striking mechanism 130 to connect with the Z-axis guiding rail 122 where the support rack 134 has a tackle (not shown in the figure) which is closely adjacent to the sidewalls of the Z-axis guiding rail 122 to reduce the friction between the support rack 134 and the Z-axis guiding rail 122. In a preferred embodiment, the constraining component 135 is directly screwed on or soldering to the support rack 134 without affecting the movement of the gear 124. Furthermore, the vertically moving gear belt 125 of the moving mechanism 120 is jointed to the support rack 134 to drive the Y-axis striking mechanism 130 moving up and down along the Z-axis guiding rail 122.

As shown in FIG. 5 as well as FIG. 2, the striking rod 132 further includes an elastic component 136 and a position-limiting switch 137 where the position-limiting switch 137 is disposed on the sliding base 132A and located at a back end of the striking head guiding bar 132B for detecting the impact of the striking head guiding bar 132B. And the elastic component 136 pushes to the back end of the striking head guiding bar 132B. The elastic component 136 provides buffering space for the striking head guiding bar 132B to avoid the striking rod 132 directly receive the striking impact during striking to prolong the lifetime of the Y-axis striking mechanism 130. Furthermore, different combinations of the elastic component 136 and the position-limiting switch 137 can serve as a stopping device for the striking rod 132. When the striking rod 132 moves forward in Y-axis direction and the striking head 110 and the striking head guiding bar 132B are stopped by a barrier panel in front of the targets but not by one of the targets caused by a miss shoot, the sliding base 132A will slightly keep moving until the elastic component 136 is compressed and the position-limiting switch 137 is triggered, and then the striking rod 132 is forced to stop the forward movement and to move backward in its retraction position. That is because that the motor 142 stops the rotations of the rotating axis 123 and the gear 124 so that the striking rod 132 including the gear bar 132E does not move forward any further, and then the rotating axis 123 and the gear 124 are rotated in the opposite direction to retract the striking rod 132 and the striking head 110. In this way, the stop of the striking head 110 due to the miss shoot can also send a failure message to the player.

Figure 6:
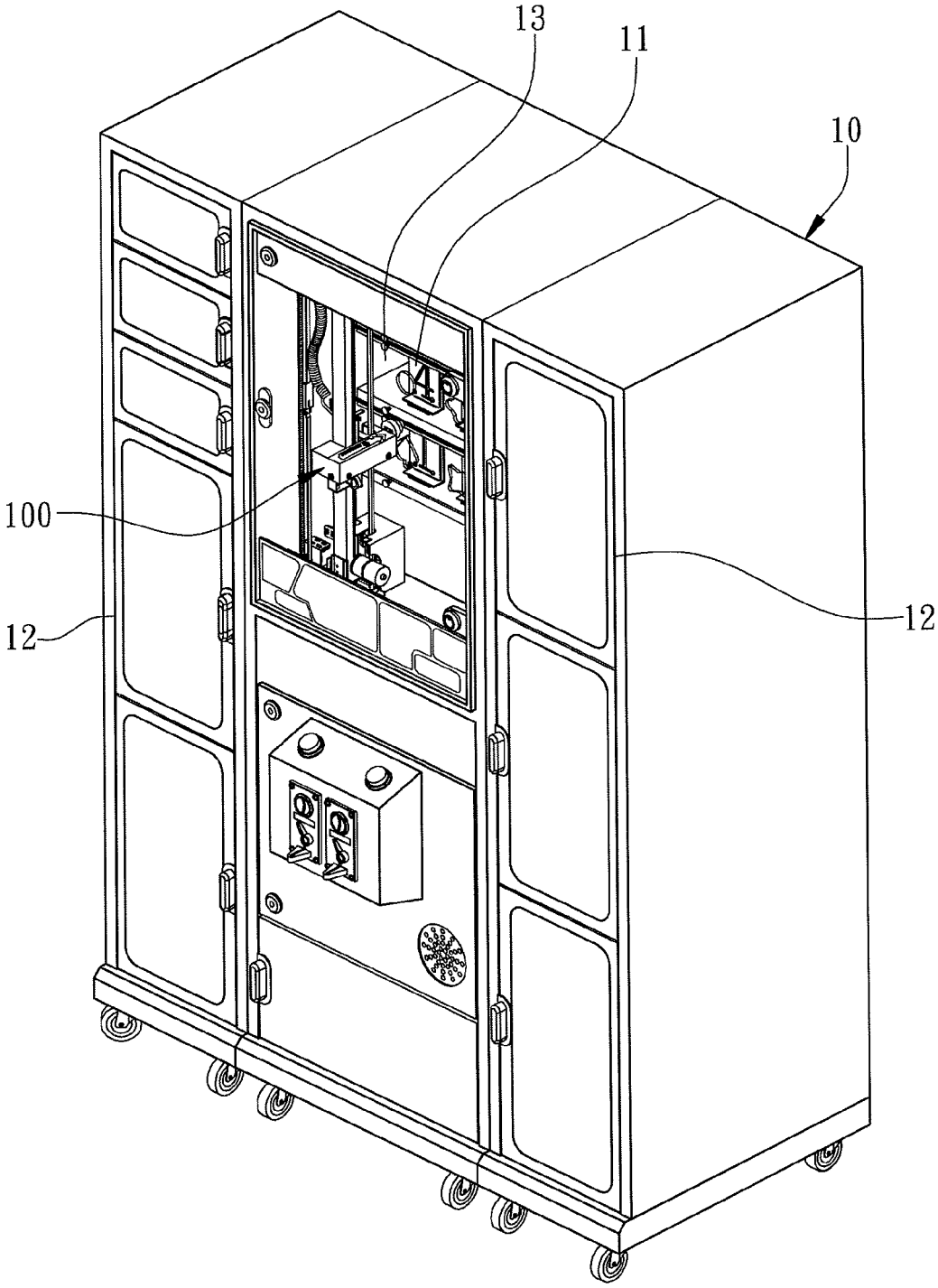
FIG. 6 is a three-dimensional front view illustrating the striking device installed in the prize-winning game machine according to the preferred embodiment of the present invention.

As shown in FIG. 6, a three-dimensional view of a prize-winning game machine 10 in which the striking device 100 is installed. The price-winning game machine 10 primarily comprises the striking device 100 and a plurality of targets 11 installed in an operation showroom. Preferably, the price-winning game machine 10 further comprises a barrier panel 13. The barrier panel 13 is located between the striking device 100 and the targets 11 to block the striking head 110 not accurately aligned to proper locations of the targets 11 in the striking device 100 to increase the challenge of the game. A plurality of prize demo boxes 12 may be designed corresponding to the numbers of the targets 11, for example, the targets 11 are numbered from 1 to 9 so when the player controls the striking head 110 in the striking device 100 to hit and knock down one of the targets 11, the prize-winning game machine 10 will open the corresponding prize demo boxes 12 to give the prize to the winner.

Figure 7:
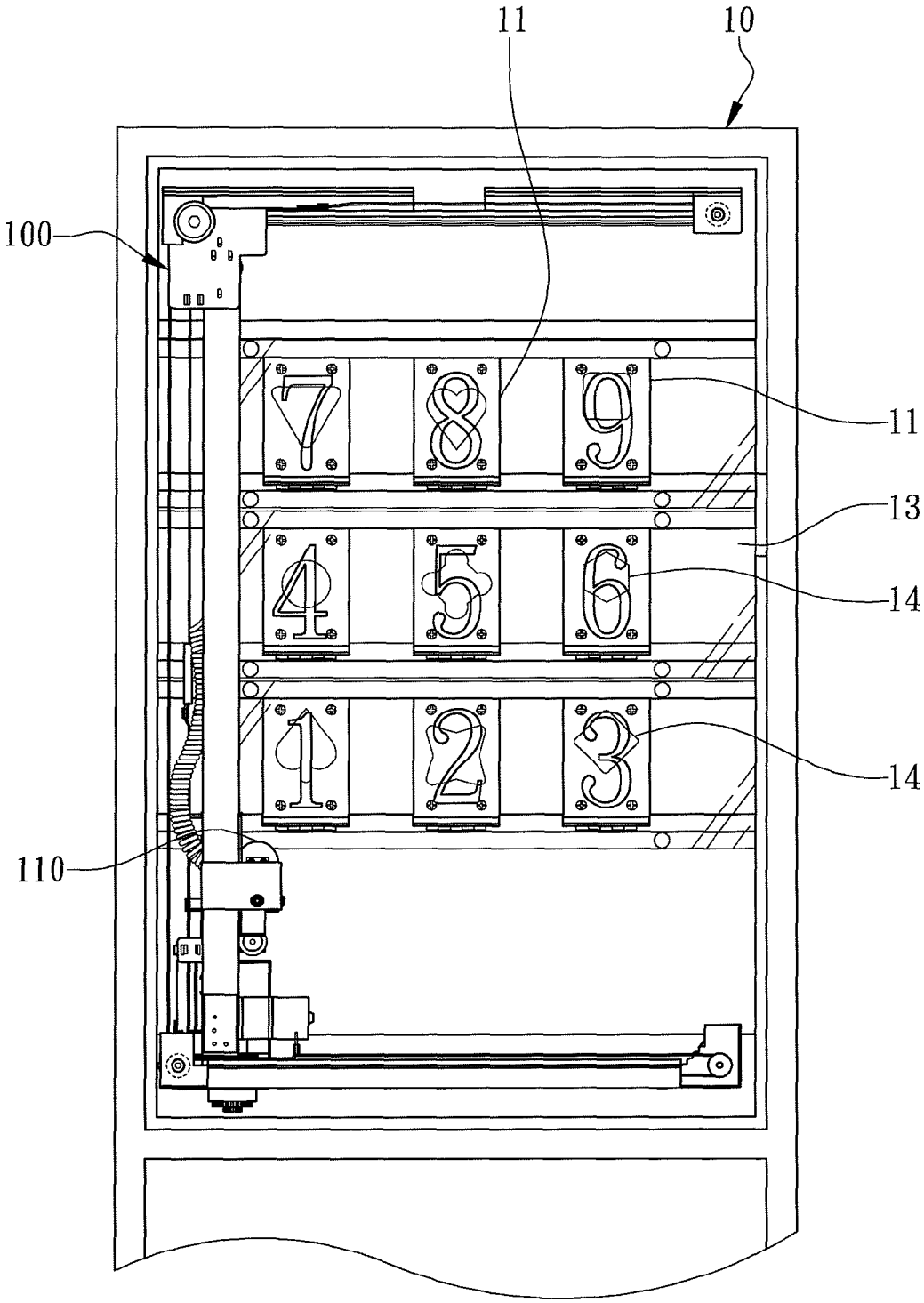
FIG. 7 is a partially view of the prize-winning game machine according to the preferred embodiment of the present invention.

As shown in FIG. 7, the barrier panel 13 has a plurality of shaped windows 14 corresponding to the targets 11. In a preferred embodiment, the shaped windows 14 are through holes designed into different shapes such as square, triangle, heart, diamond, etc. However, the dimensions of the shaped windows 14 are not smaller than the dimension of the striking head 110 to assure that the striking head 110 is possible to go through the shaped windows 14 to hit and knock down the targets 14. Furthermore, the shaped windows 14 can be designed into different shapes to increase the difficulty for the striking head 110 to go through to provide the player a choice of the preferred targets 11.

Figure 8:
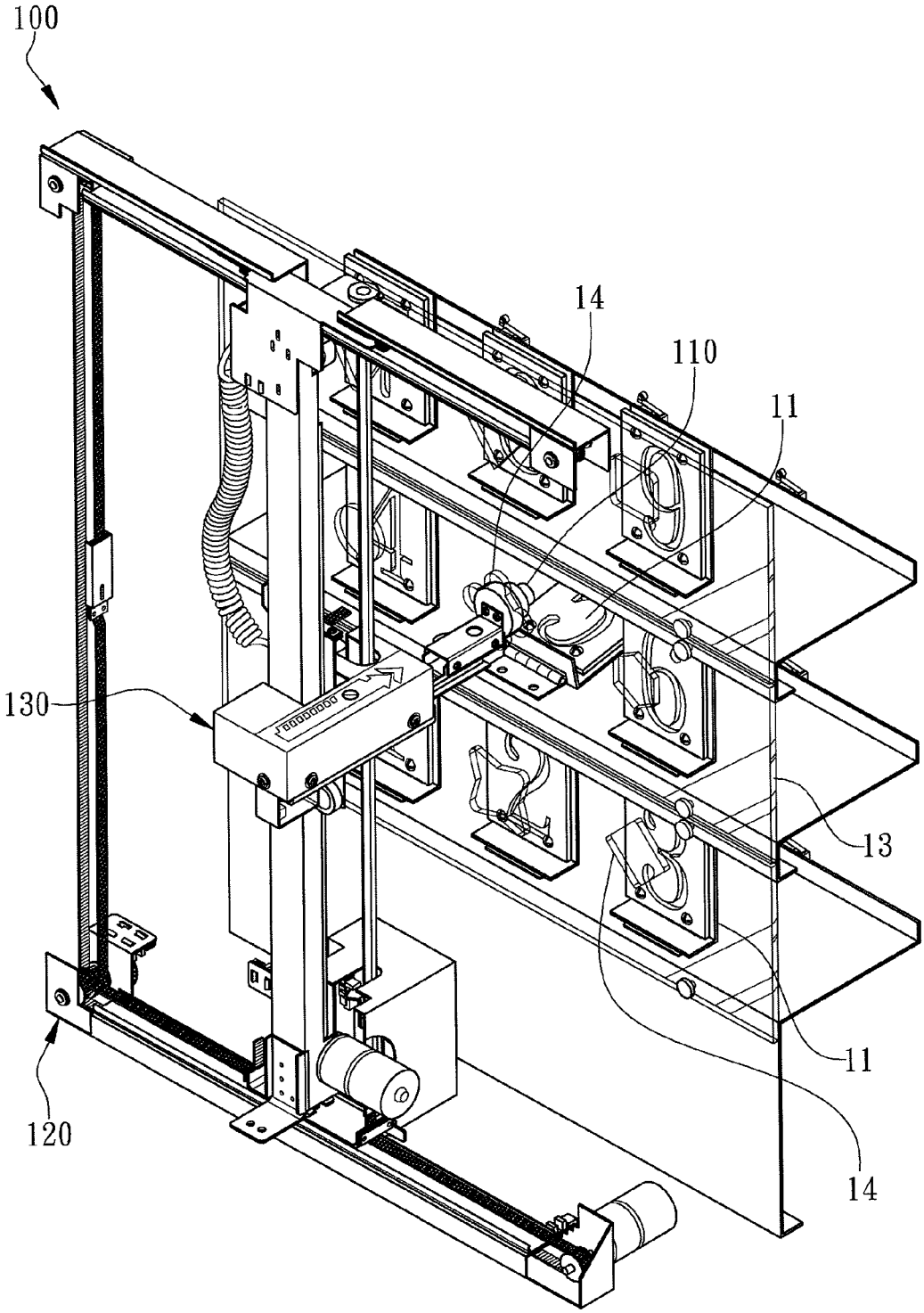
FIG. 8 is a three-dimensional view illustrating the striking head striking a target in the prize-winning game according to the preferred embodiment of the present invention.

As shown in FIG. 8, a three-dimensional view of the striking device 100 illustrating a striking head 110 can strike a target 11 through one of the shaped windows 14. If the player can position the striking head 110 well to the striking position in front of the target 11 through the moving mechanism 120 to control and adjust the Y-axis striking mechanism 130. During this process, the player enables to use the aiming mark 133A to confirm if the striking head 110 is aiming at the target 11. Then, after pushing the hit command, the striking head 110 will move forward to strike the target 11 through driving the Y-axis striking mechanism 130. As shown in FIG. 8, the striking head 110 can smoothly goes through one of the shaped windows 14 of the barrier panel 13 to successfully hit and knock down the selected target 11. The player can receive the prize from the corresponding prize demo boxes 12 as shown in FIG. 6.

The above description of embodiments of this invention is intended to be illustrative but not limited. Other embodiments of this invention will be obvious to those skilled in the art in view of the above disclosure which still will be covered by and within the scope of the present invention even with any modifications, equivalent variations, and adaptations.

What is claimed is:

1. A striking device for a prize-winning game machine, comprising:

a striking head for striking a plurality of targets in the prize-winning game machine;

an X-Z axis moving mechanism comprising two symmetrically disposed X-axis guiding rails and a Z-axis guiding rail, wherein both ends of the Z-axis guiding rail movably connected at the X-axis guiding rails; and a Y-axis striking mechanism movably connected at the Z-axis guiding rail, wherein the Y-axis striking mechanism includes a Y-axis guiding rail and a striking rod moving along and disposed on the Y-axis guiding rail, wherein one end of the striking rod is off-axis aligned to and connected to a back surface of the striking head.

2. The striking device as claimed in claim 1, wherein the striking rod is detachably assembled with the striking head.

3. The striking device as claimed in claim 1, wherein the Y-axis striking mechanism further includes a shell accommodating the Y-axis guiding rail and the striking rod, wherein an aiming mark aligned to the striking head is disposed on the shell.

4. The striking device as claimed in claim 3, wherein the aiming mark is a sticker adhered on a top surface of the shell.

5. The striking device as claimed in claim 1, wherein the striking rod includes:

a sliding base movably embedded in the Y-axis guiding rail to make the striking rod slide along the Y-axis guiding rail; and a striking head guiding bar disposed on the sliding base, wherein the connected end of the striking head guiding bar is a vertical plate locking the striking head.

6. The striking device as claimed in claim 5, wherein the striking rod further includes a reinforced plate connected and locked on the striking head guiding bar to reinforce the structure strength of the vertical plate.

7. The striking device as claimed in claim 5, wherein the striking rod further includes a gear bar disposed on the sliding base, the striking device further comprising a rotating axis disposed parallel to the Z-axis guiding rail and a gear penetrated by the rotating axis and gear-connected with the gear bar so that the gear drives the gear bar to move by rotating the rotating axis.

8. The striking device as claimed in claim 7, wherein the Y-axis striking mechanism further includes a support rack movably connecting with the Z-axis guiding axis, wherein the Y-axis guiding rail is carried on the support rack, wherein the support rack has a constraining component to simultaneously drive the Z-axis movement of the gear.

9. The striking device as claimed in claim 8, wherein the moving mechanism further comprises a vertically moving gear belt connected with the support rack to drive the Y-axis striking mechanism moving up and down along the Z-axis guiding rail.

10. The striking device as claimed in claim 7, wherein the striking rod further includes an elastic component and a position-limiting switch, wherein the position-limiting switch is disposed on the sliding base and located at a back end of the striking head guiding bar, and the elastic component is disposed to elastically push the back end of the striking head guiding bar.

11. The striking device as claimed in claim 1, wherein the moving mechanism further comprises a plurality of horizontal driving gear belts and a synchronized gear belt, wherein the horizontal driving gear belts are disposed in the X-axis guiding rails and the synchronized gear belt is disposed between the X-axis guiding rails so that the horizontal driving gear belts and the synchronized gear belt are connected to each other through a plurality of gear axes.

12. A striking device for a prize-winning game machine, comprising:

a striking head for striking a plurality of targets in the prize-winning game machine;

an X-Z axis moving mechanism comprising two symmetrically disposed X-axis guiding rails and a Z-axis guiding rail, wherein both ends of the Z-axis guiding rail movably connected at the X-axis guiding rails; and a Y-axis striking mechanism movably connected at the Z-axis guiding rail, wherein the Y-axis striking mechanism includes a Y-axis guiding rail and a striking rod moving along and disposed on the Y-axis guiding rail;

wherein the striking rod includes:

a sliding base movably embedded in the Y-axis guiding rail to make the striking rod slide along the Y-axis guiding rail;

a striking head guiding bar disposed on the sliding base and has a front end connecting with the striking head;

an elastic component disposed to elastically push a back end of the striking head guiding bar; and a position-limiting switch disposed on the sliding base and located at the back end of the striking head guiding bar.

13. The striking device as claimed in claim 12, wherein the Y-axis striking mechanism further includes a shell accommodating the Y-axis guiding rail and the striking rod, wherein an aiming mark aligned to the striking head is disposed on the shell.

14. The striking device as claimed in claim 13, wherein the aiming mark is a sticker adhered on a top surface of the shell.

15. The striking device as claimed in claim 12, wherein the striking rod further includes a gear bar disposed on the sliding base, the striking device further comprising a rotating axis disposed parallel to the Z-axis guiding rail and a gear penetrated by the rotating axis and gear-connected with the gear bar so that the gear drives the gear bar to move by rotating the rotating axis.

16. The striking device as claimed in claim 15, wherein the Y-axis striking mechanism further includes a support rack movably connecting with the Z-axis guiding axis, wherein the Y-axis guiding rail is carried on the support rack, wherein the support rack has a constraining component to simultaneously drive the Z-axis movement of the gear.

17. The striking device as claimed in claim 16, wherein the moving mechanism further comprises a vertically moving gear belt connected with the support rack to drive the Y-axis striking mechanism moving up and down along the Z-axis guiding rail.

18. The striking device as claimed in claim 12, wherein the moving mechanism further comprises a plurality of horizontal driving gear belts and a synchronized gear belt, wherein the horizontal driving gear belts are disposed in the X-axis guiding rails and the synchronized gear belt is disposed between the X-axis guiding rails so that the horizontal driving gear belts and the synchronized gear belt are connected to each other through a plurality of gear axes.

19. A prize-winning game machine comprising a striking device as claimed in claim 12 and a plurality of targets installed in an operation showroom.

20. The prize-winning game machine as claimed in claim 19, further comprising a barrier panel located between the striking device and the targets to block the striking head.

* * * * *